United States Patent [19]

Mohaupt

[11] 4,064,935

[45] Dec. 27, 1977

[54] OIL WELL STIMULATION APPARATUS

[75] Inventor: Henry H. Mohaupt, Santa Barbara, Calif.

[73] Assignee: Kine-Tech Corporation, Sacramento, Calif.

[21] Appl. No.: 722,796

[22] Filed: Sept. 13, 1976

[51] Int. Cl.[2] ..... E21B 43/26

[52] U.S. Cl. ..... 166/63; 166/299; 166/311; 102/20

[58] Field of Search ..... 166/299, 286, 63, 311, 166/165, 304; 102/21.6, 20, 21

[56] References Cited

U.S. PATENT DOCUMENTS

| | | | |
|---|---|---|---|
| 2,650,539 | 9/1953 | Greene | 102/21.6 |
| 2,842,055 | 7/1958 | Mason | 102/21.6 |
| 3,102,474 | 9/1963 | Miller et al. | 102/21.6 X |
| 3,154,013 | 10/1964 | Miller | 102/1 R |
| 3,174,545 | 3/1965 | Mohaupt | 166/165 X |
| 3,422,760 | 1/1969 | Mohaupt | 102/21.6 |
| 3,721,297 | 3/1973 | Challacombe | 166/63 X |

*Primary Examiner*—Stephen J. Novosad
*Attorney, Agent, or Firm*—Robert R. Tipton

[57] ABSTRACT

Apparatus for stimulation of oil well production utilizes a gas generating chemical charge that is placed in the oil well bore at a depth of known oil productivity and ignited to produce a gas pressure-volume pulse of known pressure-time characteristics and time duration, including means for generating a pulsating gas pressure-volume pulse.

6 Claims, 14 Drawing Figures

OIL WELL STIMULATION APPARATUS

BACKGROUND OF THE INVENTION

This invention relates generally to oil wells and in particular to a method and apparatus for stimulating oil production of wells having a low or impaired permeability.

Conditions in existing oil wells that have been producing oil for a number of years often requires remedial work or stimulation to improve the production of fluids from the formation. This stimulation may involve improvement of the permeability of the reservoir itself or merely a clearing the well bore of contamination due to drilling fluid penetration or accumulation of heavy hydrocarbons, paraffins, or tars near or at the well bore or deposition of formation fines in casing perforations or slots of well bore liners.

The methods employed in the past included shock treatments with explosives, solvent wash and the like.

The other methods utilize hydraulic pressure pumping of fluids into the oil bearing formation in an attempt to sweep or flush the debris in the clogged passages back into the cracks and extend the formation fractures and prop them open with sand. Such methods require hydraulic pumps of high pressure capability and also require the temporary positioning of a packer above the oil bearing strata.

SUMMARY OF THE INVENTION

The method of apparatus of the present invention provides a chemical gas generating charge that is placed in the oil well bore proximate the oil bearing strata and then activated to provide a controlled surge of gas pressure-volume of a known magnitude-time characteristic and directed perpendicular to the side of the well bore to flush clogged material away from the well bore and open up clogged passages for the greater flow of oil into the well bore without damaging the well. The apparatus and method includes the production of a plurality of gas pressure-volume pulses.

It is, therefore, an object of the present invention to provide a method and apparatus for stimulating oil production in existing oil wells.

It is a further object of the present invention to provide a method and apparatus for stimulating oil production in an existing oil well utilizing a chemical gas generating charge.

It is another object of the present invention to provide a method and process of stimulation of oil production in an existing oil well utilizing a chemical gas generating charge which produces gas pressure-volume pulse of known pressure-time characteristic and of known duration.

It is yet another object of the present invention to provide a method and apparatus for stimulation of oil production in an existing oil well utilizing an elongated chemical gas generating charge having a flame propogation rate less than the velocity of sound in the well fluid.

It is still a further object of the present invention to provide a method and apparatus for stimulating oil wells utilizing a chemical gas generating charge that produces a pulsating gas pressure-volume pulse.

These and other objects of the present invention will be manifest upon study of the following detailed description when taken together with the drawings.

DESCRIPTION OF THE PREFERRED EMBODIMENTS

Figure 1:
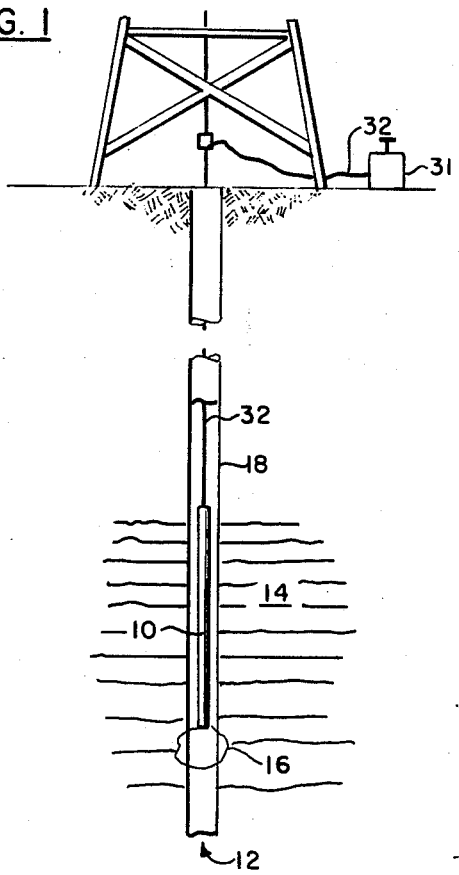
FIG. 1 is a cross-sectioned elevational view of an oil well bore showing the typical location of the device of the present invention as used.

It has been found that any gas generation being accomplished by a combustion process in a well is affected to a large degree by the hydrostatic pressure present. Exothermic processes, which progress at predictable rates under modest hydrostatic pressure, may exhibit catastrophic pressure peaks when hydrostatic confinement exceeds certain limits. These pressures may damage the well casing or other devices present in the well, shatter the cement sheath and disturb the structural integrity of the surrounding formation causing cave-ins.

It has been found that pressure pulses of the order of 30,000 psi are capable of initiating fractures in high strength formations at desired depths without inducing total rock failure and rubbelizing. It has also been found that many shallow formations respond to over-pressures of the order of 1000 psi and are successfully stimulated at this pressure range. Wells in this category are usually completed with cemented casing subsequently perforated or with slotted liners which serve as a screen for formation fines. The annulus between the slotted liner and the well bore is sometimes provided with a gravel pack. During long production periods, the perforations and slotted liners may become plugged by formation fines and thus, the flow of formation fluids into the well bore may be impeded or even blocked.

In addition, each oil well presents a further variation in parameters with respect to temperature and viscosity of crude oil being recovered. In some wells, the crude oil is recovered at relatively low temperatures but has a high viscosity comparable to axle grease, while in other wells, at the same temperature, the crude oil flows much more freely. In still other wells, the crude oil temperature is relatively high at the recovery zone or strata allowing it to flow more freely even though its viscosity may be high.

It is apparent that required stimulation of a well may be limited to opening the slots or perforations or may have to be applied through casing perforations or slots to the formation itself. The rate at which pressure equalization between the interior and exterior of the casing takes place depends upon the openings provided per length of casing. It is important that gas generation rates be proportioned to the open area. The amount of energy required to achieve any stimulation objectives varies from a minimum required for unplugging of slots and perforations (approximately 1,000 psi), to a maximum required for extensive formation fracture propagation (approximately 30,000 psi). These energy requirements are equal to approximately 1 gram to 1000 grams of propellent or chemical gas generator per foot of well bore depending upon the formulation noted below and the parameters noted above.

This may be translated to energies ranging from 500 to 500,000 horsepower or more per foot of well bore.

When the energy density determination has been matched to the required depth, well characteristics, and to the capacity of the formation to absorb the impulse without extraneous damage to the well casing and the well bore, it is imperative that the gas generating means, in the present instance, gas generating chemical charge 10, be conveyed to the well zone in an undisturbed fashion. This will have to include isolation from well fluids and may also require a rigid container to avoid so-called bunching or kinking and disorientation of the energy package.

Figure 2:
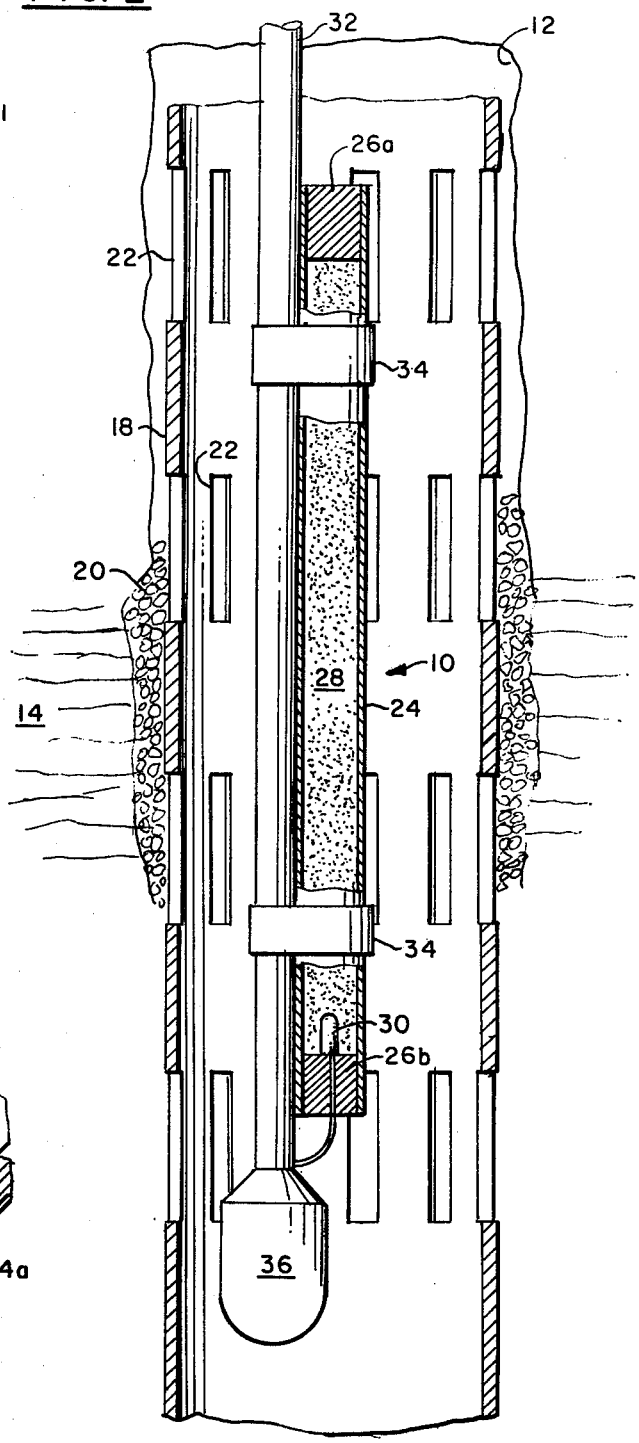
FIG. 2 is a cross-sectional elevational view of a typical chemical gas generator of the present invention.

With reference to FIGS. 1 and 2, the method of apparatus of the present invention comprises, basically, placing a gas generating chemical charge 10 in an well bore 12 at a depth of a known oil producing zone 14 and then igniting the charge 10 at its bottom end to produce a known gas pressure-volume bubble or pulse 16 which is of sufficient magnitude to flush away from the well bore 12 and, if present, from the well bore casing 18, any debris 20 clogging the well bore casing perforations 22.

FIG. 2 illustrates in greater detail a simplified version of a typical gas generating chemical charge 10 and comprises, basically, a housing 24 which is sealed at each end by fluid seals 26*a* and 26*b* and which contains a chemical gas generating mixture 28. An igniter 30 is disposed proximate the bottom end of charge 10 which is in turn connected to an electrical ignition system 31 (FIG. 1) through electrical conductors and support cable 32. Charge 10 is attached to cable 32 by means of fasteners 34. A cable-head weight 36 is attached at the bottom of cable 32 to aid in both centering charge 10 in, and to facilitate its descent down, the well bore. Typically, housing 24 may vary in outside diameter from less than an inch to 3 inches.

The rigidity of the system permits lowering gas generator charge 10 undisturbed to the zone to be stimulated where it is activated by the application of electric current to the ignitor 30 which in turn initiates combustion of the chemical generator mixture 28 at one end.

As the flame front traverses the material, an increase in pressure is registered against the walls of housing 24 which may be made from aluminum tubing or a rigid, plastic or elastomeric material. If rigid, longitudenal bursting occurs when the internal pressure reaches a given level. With a plastic material, expansion may first occur, followed by failure at the thinnest section. With an elastomeric material of sufficient thickness, exceptional swelling under the internal gas pressure may result without actually rupturing the walls of housing 24. In either case, fluids present in well bore 12 surrounding the system are rapidly displaced outward through perforations 22 in the well casing. Obstructions, such as sand, tar and debris 20, in casing perforations 22 are swept radially into the surrounding formation 14.

Fasteners 34 may comprise metallic clasps, plastic or elastomeric materials, which are strained during the gas expansion but can return to their original position after housing 24 has either ruptured or has returned to its original size after gas escape through weak spots or through the ends after ejection of the fluid seals 26. The purpose of the fastening means is to secure the system during its journey from the surface to production zone 14 and to retain all or the majority of housing 24 during and after gas generation. This is particularly important in wells that are provided with a pumping unit where debris left floating in the well fluid can seriously interfere with the operation of ball and seat valves.

PRESSURE CONTROL

Control over the pressure-time profile in the present invention is critical both from the stand point of not exceeding maximum permissible pressure and falling within the minimum pressure range necessary to perform a useful function.

When gas generation, under well fluids, is attempted with chemical compounds or mixtures exhibiting flame propagation greater than the velocity of sound in the well fluid, the results are usually more destructive than useful in that even small energy densities of such materials produce high shock pressures on the well casing resulting in damage or even splitting of the casing. In the other extreme, certain compounds or mixtures exhibit such low propagation velocities that without appropriate confinement, energy release is generally too gradual to accomplish the desired work.

The present invention provides control for shielding the well casing and related items from excessive pressure peaks and also provides the means to insure minimum gas pressure at low velocity combustion rates (flame propagation rates between 0.10 and 0.80 of the velocity of sound in the well fluid). The following embodiments represent methods and devices which keep the pressure-time profile within the desired limits, notwithstanding the wide range of propagation velocities possible.

They also represent methods and devices for creating a plurality of pressure-volume pulses superimposed on the main pressure-time profile.

Figure 3:
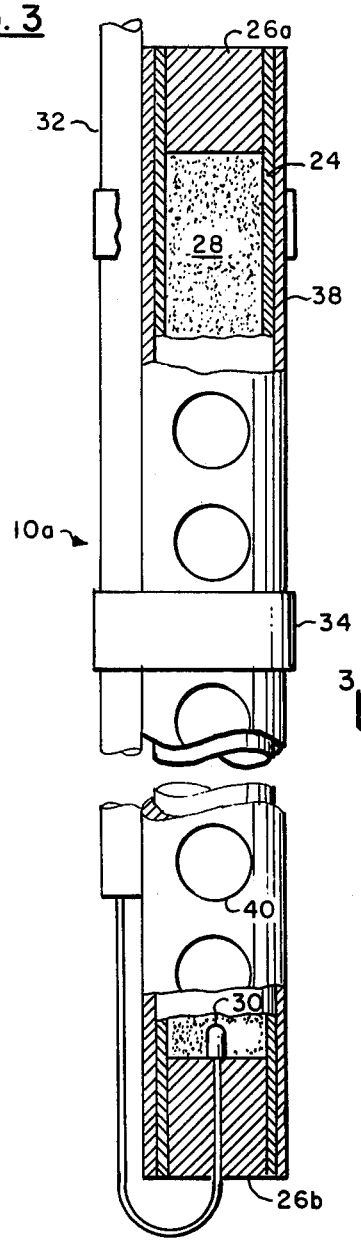
FIG. 3 is a partial cross-sectional elevational view of a second embodiment of a gas generator of the present invention utilizing a plurality of gas relief holes.

With respect to FIG. 3, there is illustrated a further embodiment of gas generating chemical charge 10 comprising the same basic elements as charge 10 of FIG. 1, however, further comprising an outer housing 38 containing a plurality of pressure relief apertures 40 disposed equidistantly along the length of housing 38.

Elongated fasteners 34 of FIG. 2 and 3 can be made from spring steel which can be small enough to not limit the expulsion of gas but strong enough to retain or hold outer housing 38 after discharge of mixture 28.

The use of apertures 40 in outer housing 38 is to facilitate pressure relief of gases generated from the ignition reaction of chemical mixture 28 in housing 24, but still serve as a protector and debris retainer for the chemical gas generator system. As the flame propagates along the length of housing 38, gas-volume pulses are periodically and sequentially released through apertures 40.

The chemical gas generator mixture 28 is contained in its own fluid proof housing 24 which may comprise a plastic or metallic (aluminum) tubing with end seals **26*a* and 26*b*. The system is fastened to cable 32, but due to its rigidity, may extend far below the cable itself. In this case, ignition of gas generator 10** may also be accomplished from the upper end or from both ends in addition to the lower end as shown.

Figure 3A:
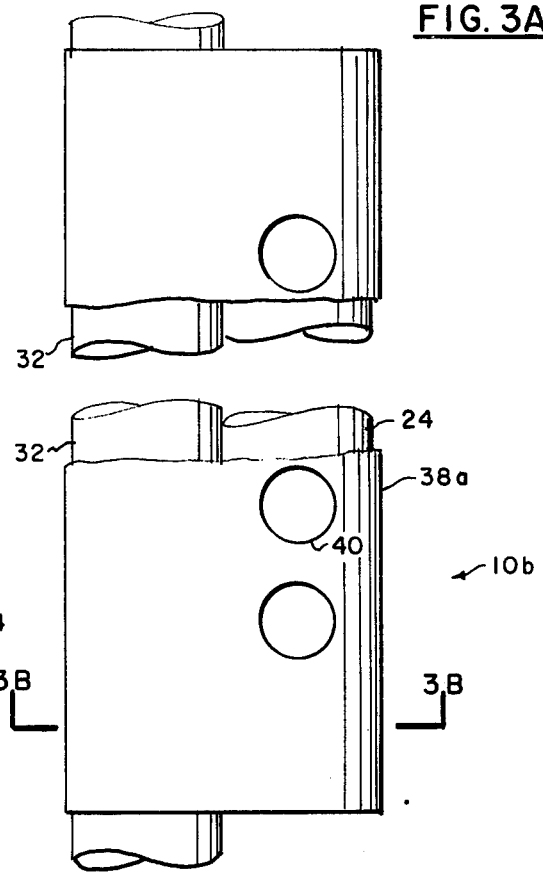
FIG. 3A is a partial cross-sectional elevational view of another embodiment of a gas generator of the present invention utilizing an enclosing jacket having a plurality of gas relief holes.
Figure 3B:
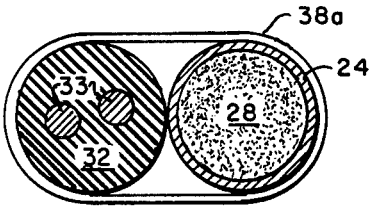
FIG. 3B is a sectional view of the gas generating charge of FIG. 3A taken at lines 3B—3B.

With reference to FIGS. 3A and 3B, a further embodiment of an enclosure or housing for mixture 38 is shown utilizing, as before, housing 24 with conductor 32 containing wires 33, the entire unit being enclosed by outer housing **38*a* also containing apertures 40 which allow the escape of gases periodically and sequentially along the length of the charge during discharge of the propellant mixture 28**.

Figure 4:
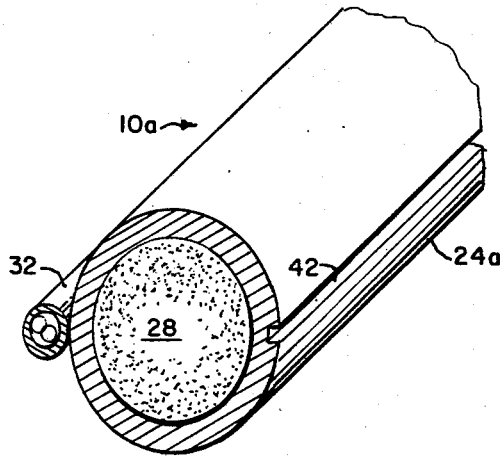
FIG. 4 is an isometric partial view of another embodiment of the chemical gas generator device of the present invention utilizing a grooved housing for controlled pressure release and producing a pulsating gas pressure-volume pulse.

FIG. 4 illustrates an isometric partial section of a tubular housing **24*a* which is provided with a longitudinal notch or groove 42 designed to predispose the unit to split open in a controlled manner under the influence of the internal gas pressure. The degree of weakening of the housing 24*a* is limited by the order of collapse pressure the unit must withstand prior to activation under the hydrostatic well pressures. Cable 32 of FIGS. 3 and 4 may be the electric conductor cable itself or it may be an extension cable attached below to the cable head (not shown in FIG. 4**) and provided with a weight at its lower end. The purpose of using such a separate cable is to protect the main cable from possible bending or other distortion when heavy concentrations of gas generator are used and heating and side thrust are magnified.

The gas generating material 28 of the present invention comprise inorganic nitrates such as sodium or potassium nitrate combined with a mixture of carbon with other oxidizable material. They can also comprise perchlorates such as ammonium perchlorate and potassium perchlorate. Commercially available burnable propellants may also be used such as "Red Dot" as manufactured by the DuPont Company and various smokeless powders commonly available in various grain sizes.

Typical formulations of chemical charges which have been found successful are listed below in Formulas A through D. The composition densities range from 1 to 1.38 grams/cc. These formulations are, by no means, the only formulations that can be used, but are representative of the types of propellant formulations found successful.

FORMULA "A"

| Chemical Compound | % by weight |
|---|---|
| Nitrocellulose powder (fine grain) | 100% |
| | 100% |

FORMULA "B"

| Chemical Compound | % by weight |
|---|---|
| Nitrocellulose powder (fine grain) | 90% |
| Aluminum powder | 10% |
| | 100% |

FORMULA "C"

| Chemical Compound | % by weight |
|---|---|
| Potassium Chlorate | 80% |
| Paraffine | 16% |
| Aluminum powder | 4% |
| | 100% |

FORMULA "D"

| Chemical Compound | % by weight |
|---|---|
| Fine grain smokeless powder | 40% |
| Potassium Perchlorte | 39% |
| Aluminum powder | 18% |
| Corn Starch | 3% |
| | 100% |

The gas generating material of the present invention is used in a manner where flame propagation is the primary characteristic depended upon for the controlled and gradual release of energy to produce a controlled gas pressure-volume pulse.

Whereas the prior art devices attempted to operate on a pressure pulse having a duration of microseconds, the device and process of the present invention operates using a pressure pulse of millisecond duration or more and with a flame propagation rate of from 0.10 to about 0.75 or 0.80 of the velocity of sound in the well fluid.

This gradual energy release and gas evolution permits timely displacement of the surrounding well fluids through perforations or slots 22 (FIG. 2) into the surrounding strata 14 and equalization of pressure. This mode of combustion propagation is dependent upon voids between the propellant particles to allow passage of the flame front. Well fluids must therefore be excluded by the protective housing 24. Housing 24 may be of material such as plastic tubing, such as polyvinyl chloride or metallic tubing such as aluminum, which can deform without failure when exposed to the high external pressures encountered in a typical oil well.

The combustion of elongated chemical gas generators using a combination of chemicals capable of a rapid and sustained gas evolution reaction under varying conditions of confinement, hydrostatic heads, etc. is subject to irregularities which may cause changes in chemical reaction propagation rate and in some cases complete stoppage of combustion or chemical reaction and failure of the system. Some of these failures have been traced to the compaction of the chemical constituents ahead of the flame front while others have been caused by a combination of compaction, retardation and contamination of the chemical charge particles with well fluids prior to being exposed to the combustion reaction as a result of premature rupture of the housing.

Figure 5:
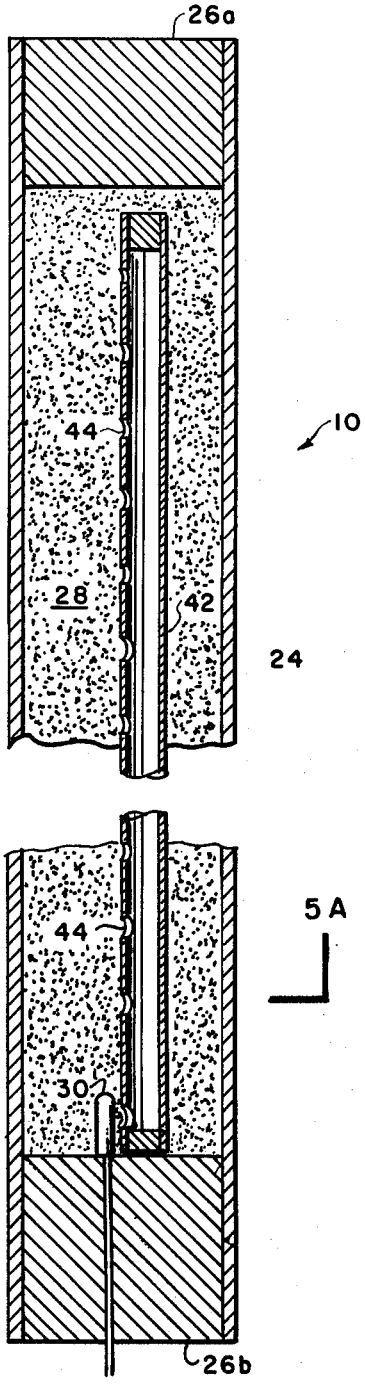
FIG. 5 is a cross-sectional elevational view of a chemical gas generating charge of the present invention utilizing a flame propagation tube to produce a gas pressure-volume pulse of known magnitude and duration.
Figure 5A:
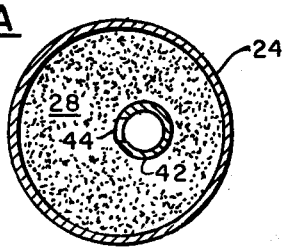
FIG. 5A is a cross-section of the gas generator of FIG. 5 taken at line 5A—5A.

As an aid to flame propagation and to insure against compaction of the propellant charge, i.e., compaction which might retard burning, a flame propagation tube 42 can be used as illustrated in FIGS. 5 and 5A. In all other respects, the elements of charge **10*b* of FIG. 5 are identical to charge 10 of FIG. 2**.

Propagation tube 42 can be constructed of any combustible or non-combustible material and further comprises a plurality of equally spaced flash holes 44 disposed along its length. Holes 44 must be covered with a fine mesh material in order to prevent grains of chemical mixture 28 from falling into tube 42.

When ignitor 30 is energized, chemical mixture 28 is ignited and begins gas generation. The hot gases begin to expand and are admitted into the empty propagation tube 42 by the flash holes 44 where they can expand essentially unimpeded along the length of the tube. As the flame front proceeds in the empty propagation tube, it is able to expand laterally through the flash holes into the propellant not yet undergoing combustion and effect ignition. In the event of compaction of chemical charge mixture 28 and corresponding reduction in burning rate, propagation tube 42 provides an independent flame communication throughout the length of the charge. Depending on the pressures generated, the flame propagation velocities in the tube will exceed 2000 ft/sec. and reach about 4,000 ft/sec. The rigidity or collapse strength or tube 42 must be high enough to preserve the free space required for unimpeded flame propagation.

Nylon mesh has been successfully used to cover the holes 44. Hot gases are thus permitted to pass in either direction without undue cooling. Tube 42 may also be made of a combustible material such as nitrocellulose, etc. provided that the wall thickness is adequate to prevent premature failure by collapse.

The propagation tube cover for holes 44 can also be made of thin plastic such as polyethylene, polyvinyl chloride, etc. in thicknesses of about 0.001 inch or thin paper. Such covers are readily punctured in either direction by the hot propellant gases.

To insure continued combustion propagation in long tubes without flame propagation tube 42, it has been found that propagation failure can sometimes be attributed to premature heat losses in the column or gas bubbles of low heat content within the flame front. It has been found that certain chemical compositions containing oxydizers and aluminum, for instance, generating very high reaction temperatures but relatively low pressure in the region of the flame front and are not so prone to the erratic stoppages associated with conventional combustible chemical charges. Such compositions will propagate in relatively weak plastic tubes although combustion may not be complete. The confinement can then be increased until the reaction is forced to completion.

In order to achieve stronger confinement, thicker walled plastic tubing may be selected or metallic tubing such as copper, aluminum, mild steel, or various alloys of these metals, may be used. These tubes usually have a known internal bursting pressure and suitable wall thickness and strength can thus be selected accurately by a person skilled in the art.

PULSATING PRESSURE PULSE

When an elongated gas generator system is activated under a hydrostatic head, the gas pressure must first rise to overcome the combined bursting pressure of its container and the hydrostatic pressure of the surrounding fluid. With gas generators of the prior art which depend upon propagating by shock pressure at high velocity, this minimal pressure is reached within microseconds, whereas the slower propagation characteristics incorporated in the present invention result in pressure rises in terms of milliseconds or slower. As this overpressure is imparted to the surrounding fluid, the pressure is communicated at the velocity of sound in all directions within the fluid, declining in magnitude with distance.

It has been found that stimulation for several well conditions is enhanced by this pulsating pressure rather than uniform pressure applications.

Figure 6:
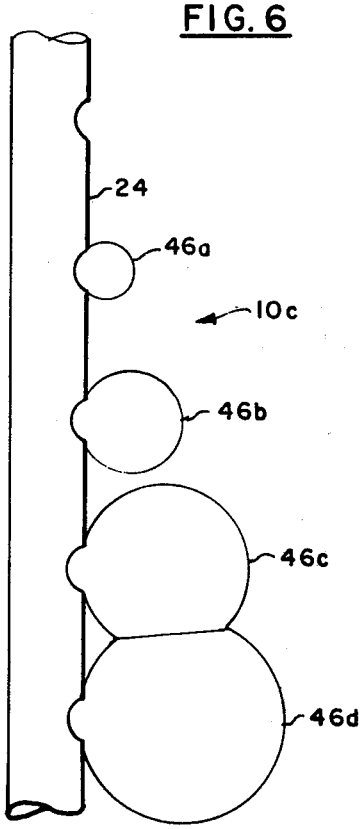
FIG. 6 is an elevational view of a pulsating gas generator illustrating the progressive evolution of the overlapping pulse gas discharge.
Figure 6A:
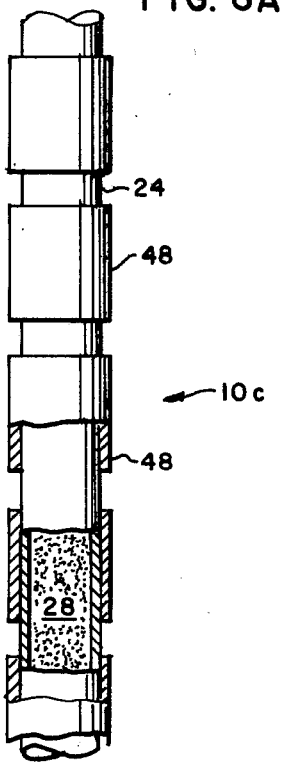
FIG. 6A is an elevational, partial sectional view of a gas generator having reinforcing bands also for producing the gas pressure-volume pulses shown in FIG. 6.

With reference to FIGS. 6 and 6A, there is illustrated a gas generator charge 10*c* used to generate a plurality of gas pressure-volume pulsations during one longer pressure-volume pulse.

In FIG. 6, several cycles are indicated with initially discreet but later overlapping gas volumes 46 (46*a* through 46*d*) in the various stages of expansion, according to the sequence of their release. In FIG. 6, the propellant mixture is initially ingnited at the bottom of charge 10*c*. From FIG. 6 it might be inferred that the separate gas volumes will interact during the latter stages of expansion. However, it has been found that gas spheres generated under fluids undergo numerous pulsation cycles of expansion and contraction and even though neighboring gas spheres may merge during their maximum expansion, the energy stored in the surrounding fluid will induce contraction into separate spheres. The net result is numerous overlapping pressure pulses are received by the surrounding well casing 18 and strata 14 which are superimposed upon the overall pressure-volume pulse.

It is possible to accomplish this pulsation in the low velocity range by providing a gas generator having a propagation velocity of less than the velocity of sound in the well fluid. This velocity of sound varies between approximately 4350 to 5600 ft/sec., depending upon the well fluid mixture. With this particular combination, the pressure distribution from the initial gas release in the surrounding well fluid overtakes the subsequent gas generation thus exerting an excessive external pressure on the device. As a consequence, the internal gas pressure is inadequate to burst the container until the reaction has progressed a distance at which the external pressure signal has decayed. At this point, the cycle is repeated; the tube splits releasing the accumulated high pressure gas which in turn immediately induces a back pressure by the fluid on the tube preventing further splitting. Tests with this system using aluminum or polyethylene tubing of a configuration as shown on FIG. 4 have resulted in splits occurring alternately with undamaged sections at regular intervals along the tube. During each cycle, a portion of the energy is expended in the surrounding well casing, its perforations and the formation.

As the diameter of the gas generator system is increased in relation to the well bore, the opportunity for spherical expansion is reduced and expansion of the gas volume takes place by compression and oscillation of the well fluid in the direction of the well bore axis and in formation fractures.

The pulsation cycle can be altered by providing reinforcing sleeves 48 surrounding housing 24 as shown in FIG. 6A which prevent splitting or bursting of the housing in selected areas between reinforcing sleeves.

Conversely the housing can be weakened at desired intervals either on one side or symmetrically to induce gas release at these points.

For example, with reference to FIG. 6A, chemical charge 10*c* is provided with a plurality of equally spaced apart reinforcing members 48 along housing 24 to provide weak points along charge 10*c* to burst as the flame propagates along mixture 28 in housing 24.

FIG. 3, previously described, is a further example using apertures 40 as the weak points in the structure of charge 10*a*. If a groove 42 is used as in FIG. 4, the groove should be periodically discontinuous, as for example, groove 51 in FIG. 7.

The frequency of pulsation and interaction of adjacent gas spheres is related to the medium of propagation, its boundaries and the spacing of the spheres. The general effects that occur when disturbances set up by underfluid gas release, come in contact with a different medium of boundary is of considerable importance. It must be assumed that the boundary between two media having different mechanical properties, such as density, compressibility, exhibit the same pressures at adjacent points on either side of the boundary and that the components of particle velocity perpendicular to the boundary are the same at adjacent points. Expansion of the gas sphere continues until compression of the surrounding fluid exceeds that of the gas or until the gas sphere contacts an essentially incompressible boundary such as the well casing. In the latter case, some distortion of the gas sphere will naturally occur but the tendency of the highly compressed fluid to spring back to the original geometry while returning energy to the gas. This spring-back is likely to occur even when adjacent gas spheres come in contact inasmuch as the densities and elasticities are similar.

Figure 7:
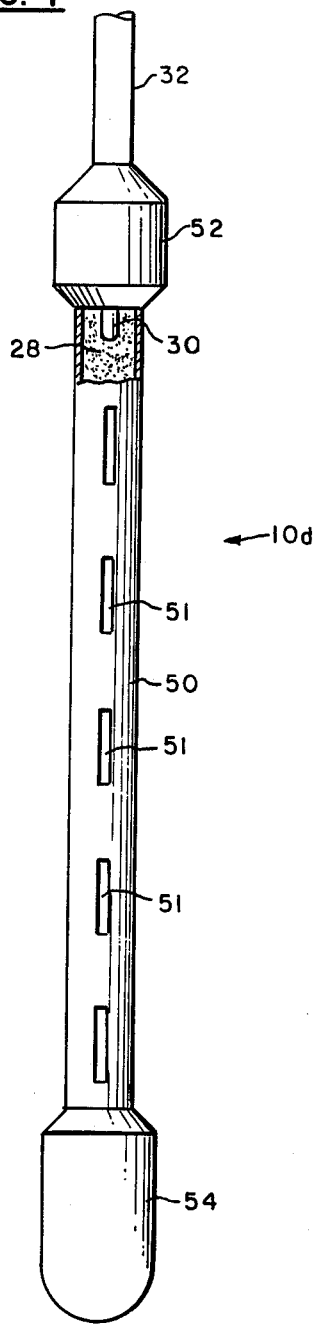
FIG. 7 is a partial cross-sectional elevational view of a chemical gas generator housing adapted to produce a pulsating pressure-volume pulse.

A further embodiment of the gas generating charge of the present invention is illustrated in FIG. 7 which comprises a gas generator charge 10*d* having a housing 50 designed to split at intervals longitudinally along groove 51 without loss of tensile stength but which can be quite flexible. It is attached at the upper end to cable 32 through cable head connector 52 containing the electrical connections for igniter 30.

To keep housing 50 generally straight, an expendible weight 54 is attached at the bottom. This weight may be constructed of such drillable material as concrete or lead. After discharge of the device, since failure of housing 50 will occur only at slits 51 with the balance of housing 50 left intact, the conductor 32, cable head 52 and spent housing 50 can be removed from the well bore leaving little debris behind.

Figure 8:
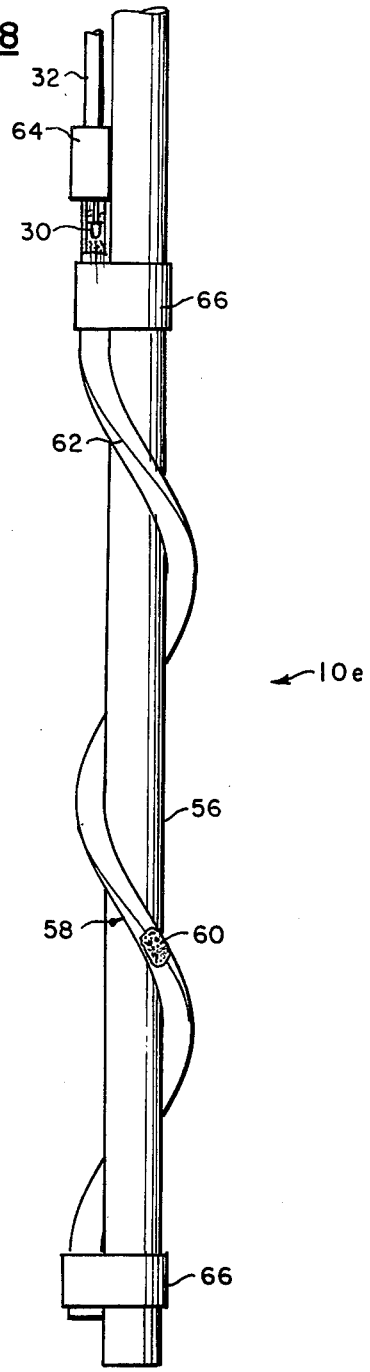
FIG. 8 is an elevational view of a spiral wound configuration for a chemical gas generating device.

With reference to FIG. 8, a further embodiment of the device of the present invention is illustrated which is also adapted to be withdrawn from a well bore to leave little debris behind.

Gas generator charge 10*e* of FIG. 8 comprises, basically, a support cable or reinforcing rod 56 around which is wound, in a helical manner, housing 58 containing a chemical mixture 60 and design to split open along groove 62.

Housing 58 is attached at its upper end to cable head 64 containing the various electrical connections to igniter 30 for initiating release of energy. Housing 58 is attached at its upper and lower end to rod 56 typically by clamps 66.

This configuration for charge 10*e* has the advantage of generating its gas pressure-volume release in a 360° direction.

Figure 9A:
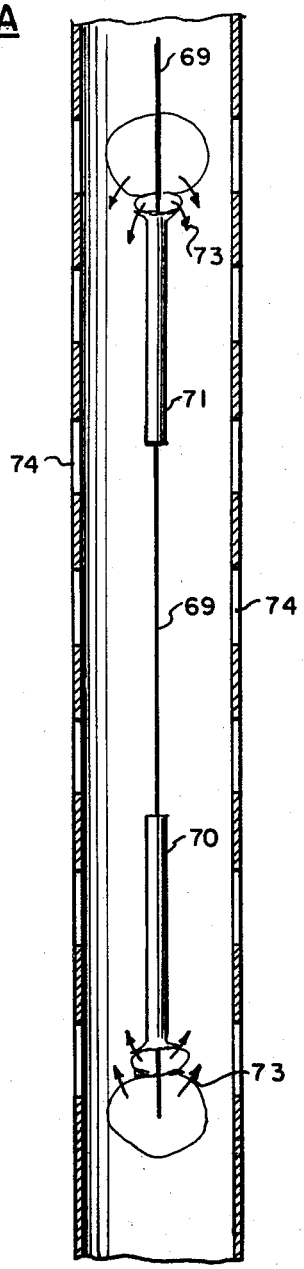
FIGS. 9A and 9B are elevational views of a double spaced apart chemical gas generator capable of being withdrawn from the well bore after discharge of the generator shown at an early stage of discharge (FIG. 9A) and a later stage of discharge (FIG. 9B).
Figure 9B:
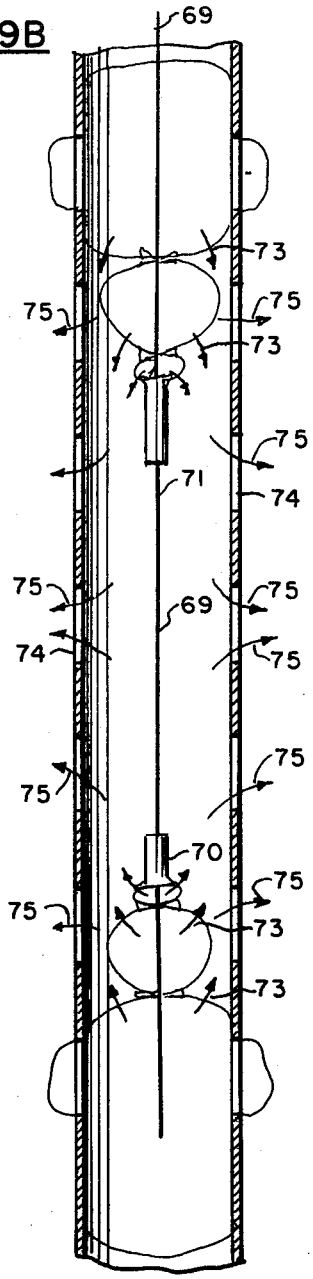

With reference to FIGS. 9A and 9B, there is illustrated a further embodiment of the present invention utilizing two gas generating charges attached to cable 69, namely, lower charge 70 and upper charge 71, which are ignited simultaneously at their opposite ends to produce simultaneously a plurality of pressure-volume pulses propagating upward from chemical gas generating charge 70 and downward from chemical gas generating charge 71 as indicated by arrows 73 to create a compression of the well fluid between the charges and force the fluid in between through perforations 74, as indicated in FIG. 9B by arrows 75, thus extending the length of well bore treated by a double charge unit or tool.

PROCESS

The process of the present invention is performed by first lowering charge 10 down to an oil bearing strata 14 as shown in FIG. 1 under a well fluid.

Charge 10 is then ignited at one end through ignition system 31.

Depending upon the choice of charge design, a gas volume is released having a peak pressure below the stress limits of the well bore (approximately 30,000 psi) and above the minimum back flow pressure (approximately 1,000 psi) needed to force fluids into the surrounding oil bearing strata.

The step includes the discharge of a chemical gas generating charge 10 having a flame propagation rate between 0.1 and 0.75–0.80 of the velocity of sound in the well fluid and, if further enhancement of the pulsation is desired, spaced apart strong and weak sections along the length of its outer housing.

SPECIFIC EXAMPLE

Tests based on placing a propellant charge in a water-oil mixture placed in a three inch diameter steel pipe having an opening with an area of one square inch produced the following results:

| Weight of Propellant Charge in Grams | Distance from Port in Inches | Propellant Discharge Milliseconds | Maximum Overpressure In psi |
|---|---|---|---|
| 22.0 (Formula "D") | 12 | 1.0 | 3,000 |
| 60.0 (Formula "D") | 12 | 1.0 | 7,750 |
| 5.4 (Formula "D") | 48 | 1.0 | 6,750 |
| 15.0 (Formula "D") | 48 | 1.0 | 8,500 |

(Neither a packer nor plug was provided above the fluid column.)

With these test parameters and the known well parameters, a tool or device 10, based on the discovery that the flame propagation rate for satisfactory results must be less than the velocity of sound in the well fluid, a well stimulation tool or device can be created.

For example, for a well having a steel liner diameter of 7 inches and an open area of 5.27 sq. in./ln. ft. of liner, with an average opening size of 0.2 square inches, a well fluid having a velocity of sound characteristic of roughly 5500 ft/sec. at a well depth of 7,400 ft. and an hydraulic head of 1,000 ft., a tool or device 10 having the following dimensions and operating parameters has been found to produce successful results:

Propellant formulation: Formula "D"
I.D. of propellant tube: 5/16 inch
Tube material: Aluminum
Weight of Propellant/ln. ft.: 22 grams
Total weight of propellant: 1,320 grams
Total length of propellant: 60 feet
Propellant discharge pulse duration: 86 milliseconds
Flame propagation rate: 700 ft./sec.

For the well tested, the oil flow rate before stimulation was 1.5 barrels/day. The oil flow rate after stimulation was 4.0 barrels/day.

It must be noted that the well fluid consisted of both water and oil and although the total flow increased, the above noted flow rate is for oil only and does not include other non-petroleum well fluids.

I claim:

1. An apparatus for stimulating the flow of oil and well fluids in an oil well comprising means defining an elongated fluid proof frangible housing adapted to be received in an oil well bore, an elongated, generally evenly distributed burnable chemical gas generating charge having a generally uniform cross section along the length of said charge, and having a linear flame propagation velocity less than the velocity of sound in the well fluid located within said fluid proof frangible housing, and means for igniting said elongated burnable gas generating chemical charge beginning at one location of said elongated charge.

2. The apparatus as claimed in claim 1 wherein said linear flame propagation velocity ranges between 0.1 and 0.8 of the velocity of sound in the well fluid.

3. An apparatus for stimulating the flow of oil and well fluids in an oil well comprising means defining an elongated fluid proof housing adapted to be received in an oil well, said housing comprising a plurality of means, each spaced apart from each other, along the length of said housing, for releasing a pressure-volume pulse of gas sequentially in time as said flame propagates along said elongated chemical charge, said means for releasing a pressure-volume pulse of gas comprising a reinforcing member encasing said housing at intervals along its length having a strength sufficient to withstand the gas pressure generated by said chemical charge, an elongated, generally evenly distributed burnable chemical gas generating charge having a linear flame propagation velocity less than the velocity of sound in the well fluid located within said fluid proof housing, and means for igniting said elongated burnable gas generating chemical charge beginning at one location of said elongated charge.

4. The apparatus as claimed in claim 3 wherein said means for release of a pressure-volume pulse of gas comprises a structure weakening groove located in said housing.

5. An apparatus for stimulating the flow of oil and well fluids in an oil well comprising means defining an elongated fluid proof housing adapted to be received in an oil well bore, said housing comprising a continuous structure weakening groove disposed along the length of said housing, an elongated, generally evenly distributed burnable chemical gas generating charge having a linear flame propagation velocity less than the velocity of sound in the well fluid located within said fluid proof housing, and means for igniting said elongated burnable gas generating chemical charge beginning at one location of said elongated charge.

6. An apparatus for stimulating the flow of oil and well fluids in an oil well comprising means defining an elongated fluid proof frangible housing adapted to be received in an oil well bore, an elongated, generally evenly distributed, uniformly burnable chemical gas generating charge having a generally uniform cross section along the length of said charge located within said fluid proof frangible housing, means for maintaining the linear flame propagation velocity of said elongated chemical gas generating charge less than the velocity of sound in said well fluid, and means for igniting said elongated burnable gas generating chemical charge beginning at one location of said elongated charge.

* * * * *

UNITED STATES PATENT AND TRADEMARK OFFICE

CERTIFICATE OF CORRECTION

PATENT NO. : 4,064,935

DATED : December 27, 1977

INVENTOR(S) : HENRY H. MOHAUPT

It is certified that error appears in the above—identified patent and that said Letters Patent is hereby corrected as shown below:

On the title page, delete:

"[73] Assignee: Kine-Tech Corporation, Sacramento, Calif."

Signed and Sealed this

*Seventeenth* Day of *November 1981*

[SEAL]

*Attest:*

GERALD J. MOSSINGHOFF

*Attesting Officer*

*Commissioner of Patents and Trademarks*